US009707664B2

(12) United States Patent
Ishikawa et al.

(10) Patent No.: US 9,707,664 B2
(45) Date of Patent: Jul. 18, 2017

(54) ZINC-BASED ALLOY SHOT

(75) Inventors: Masayuki Ishikawa, Toyokawa (JP); Kaoru Hirai, Toyokawa (JP)

(73) Assignee: SINTOKOGIO, LTD. (JP)

( * ) Notice: Subject to any disclaimer, the term of this patent is extended or adjusted under 35 U.S.C. 154(b) by 858 days.

(21) Appl. No.: 13/993,780

(22) PCT Filed: Jul. 27, 2011

(86) PCT No.: PCT/JP2011/067102

§ 371 (c)(1),
(2), (4) Date: Jun. 13, 2013

(87) PCT Pub. No.: WO2012/081276

PCT Pub. Date: Jun. 21, 2012

(65) Prior Publication Data

US 2013/0259737 A1 Oct. 3, 2013

(30) Foreign Application Priority Data

Dec. 16, 2010 (JP) ..... 2010-280807

(51) Int. Cl.
*C22C 18/02* (2006.01)
*B24C 11/00* (2006.01)
(Continued)

(52) U.S. Cl.
CPC ..... *B24C 11/00* (2013.01); *B22F 1/0011* (2013.01); *B22F 9/08* (2013.01); *C22C 18/02* (2013.01)

(58) Field of Classification Search
CPC .. B22F 1/0011; B22F 1/0048; B22F 2304/10; B22F 2304/15; B24C 1/08; B24C 1/083; B24C 1/086; B24C 1/10; B24C 11/00
See application file for complete search history.

(56) References Cited

U.S. PATENT DOCUMENTS

2012/0294756 A1* 11/2012 Yamaguchi ..... B24C 1/083 420/515

FOREIGN PATENT DOCUMENTS

CN 1943992 A * 4/2007
GB 2046302 A * 11/1980 ..... B22F 7/00
(Continued)

OTHER PUBLICATIONS

English-Language International Search Report issued by the Japanese Patent Office in International Application No. PCT/JP2011/067102, mailed Aug. 23, 2011 (1 page).
(Continued)

*Primary Examiner* — Scott Kastler
*Assistant Examiner* — Vanessa Luk
(74) *Attorney, Agent, or Firm* — Finnegan, Henderson, Farabow, Garrett & Dunner, LLP

(57) ABSTRACT

This invention provides a zinc-based alloy shot having a new formation and it also provides a method of manufacturing it. The zinc-based alloy shot has Cu added, and it is likely to have a relatively high hardness, and it is less likely to corrode (reduce color change) when it functions as a shot. The zinc-based alloy shot of the present invention comprises Cu as the main additive element for increasing the Vickers hardness, etc., and Fe as a co-additive element for increasing the Vickers hardness and for preventing corrosion. It gives a Vickers hardness of 40-150 HV. The chemical composition of the zinc-based alloy shot is usually Cu: 0.1~13.0%; Fe: 0.0025~0.25%; Zn: balance; and 1≤Cu/Fe (measured in mass)≤1000.

8 Claims, 3 Drawing Sheets

(51) Int. Cl.
*B22F 1/00* (2006.01)
*B22F 9/08* (2006.01)

(56) References Cited

FOREIGN PATENT DOCUMENTS

| | | | | | |
|---|---|---|---|---|---|
| JP | 60-120763 | | | 8/1985 | |
| JP | 09-070758 | | | 3/1997 | |
| JP | 09070758 | A | * | 3/1997 | |
| JP | 11-320416 | | | 11/1999 | |
| JP | 11320416 | A | * | 11/1999 | |
| JP | 2001-162538 | | | 6/2001 | |
| JP | 2002-224962 | | | 8/2002 | |
| JP | 2002224962 | A | * | 8/2002 | |
| JP | 2007-084869 | | | 4/2007 | |
| JP | 2007-177278 | | | 7/2007 | |
| JP | 2009-226535 | | | 10/2009 | |
| JP | WO 2011052287 | A1 | * | 5/2011 | ..... B24C 1/083 |

OTHER PUBLICATIONS

International Preliminary Report on Patentability dated Jul. 11, 2013 in PCT/JP2011/067102 (5 pages).

* cited by examiner

ZINC-BASED ALLOY SHOT

CROSS-REFERENCE TO RELATED APPLICATIONS

This application is a national phase application of International Application No. PCT/JP2011/067102, filed Jul. 27, 2011, and claims the priority of Japanese Patent Application No. 2010-80807, filed Dec. 16, 2010, the content of all of which is incorporated herein by reference.

TECHNICAL FIELD

This invention relates to a zinc-based alloy shot that is mainly used for shot blasting for removing flash and burrs (hereafter, "deburring") and shake-out of castings, removing burnt lubricants and parting agents, or removing oxide film and flow marks (hereafter, "grinding and polishing"). Particularly this invention relates to a zinc-based alloy shot that is suitably used for treatment of the surface of a light alloy product made from an aluminum alloy, a zinc alloy, or a magnesium alloy.

The technical terms in the present specification and the claims herein have the following meanings:

"Vickers hardness" is measured according to "JIS Z 2244" by a testing power of 0.4093N, and a holding time of 10-15 sec. "Vickers hardness" is usually denoted by " . . . HV0.05." But in this specification it is shown by " . . . HV."

"%," where it denotes an alloy composition, means a "wt %," unless specified otherwise.

The term "average particle diameter" of shots in the specification means a "median diameter: 50% value of the cumulative distribution," unless specified otherwise.

BACKGROUND

In a zinc shot made solely from zinc, a particle-cloud that is produced by shot-crushing has a lower sensitivity to an explosion and its lower boundary for a concentration for an explosion is higher compared with that of aluminum alloy shot or stainless steel shot.

However, the zinc shot is likely to cause a darkening on work to be treated. Also, it has hardness of 40-50 HV in Vickers hardness, and it is soft, such that the effect of a surface treatment is insufficient. So, it takes longer to complete a blasting treatment if the zinc shot is used (Patent Document 1, Paragraph 0004).

To prevent a darkening and to increase the hardness of zinc shot, a zinc-based alloy that has various alloys added to the zinc of the zinc shot is proposed (References 1-6).

To solve these problems, for example, Patent Documents 1 and 2 propose adding Cu, Patent Document 3 proposes adding Ni, Patent Document 4 proposes adding Mn, Patent Document 5 proposes adding Cu and Mn, and Patent Document 6 proposes adding Mg.

RELATED DOCUMENTS

Patent Document 1: Publication of Japanese patent application, Publication No. H9-070758 (abstract, etc.)

Patent Document 2: Publication of Japanese patent application, Publication No. 2002-224962 (abstract, etc.)

Patent Document 3: Publication of Japanese patent application, Publication No. H 11-320416

Patent Document 4: Publication of Japanese patent application, Publication No. 2001-162538

Patent Document 5: Publication of Japanese patent application, Publication No. 2007-84869

Patent Document 6: Publication of Japanese patent application, Publication No. 2009-226535

SUMMARY OF INVENTION

Problem to be Solved by the Invention

The present invention is directed to a zinc-based alloy shot having a new formation and to a method of manufacturing it where the zinc-based alloy shot has Cu added, and where it is likely to have a relatively high hardness, and it is less likely to corrode (to rust) when functioning as shots, and, further, it is not easily broken into particles nor does it easily wear out by use.

Means to Solve Problems

To solve the problems (purpose), the inventors of the present invention found that zinc shot that has the conventional Cu-added zinc-based alloy and having the following formation can be easily formed into shot having a relatively high hardness, and at the same time corrosion (rust) is prevented from occurring on it.

The present invention relates to a zinc-based alloy shot that has a formation where it comprises Cu as the main additive element for increasing the Vickers hardness, etc., and Fe as a co-additive element for increasing the Vickers hardness and for preventing corrosion, and where it gives a Vickers hardness of 40-150 HV.

Effect of the Invention

The zinc-based alloy shot of the present invention has an increased Vickers hardness and at the same time is less affected by any corrosion (coloring over time) on the shot if Fe is added as a co-additive element to the zinc-based alloy, to which Cu is added as the main additive element (see the results of the corrosion test below). As a result, the value of the shot as a product (mainly in appearance) increases. One of the things that cause darkening of the workpiece (hereafter, "work") is considered to occur when the shot collides with the work in the shot blasting treatment, etc., because any corroded area that is on the surface of the shot is transferred onto the surface of the work. But by adding a small amount of Fe as the co-additive element, corrosion of the shot itself is reduced, such that lowering the darkening of the work in the shot blasting treatment is expected.

Also, unlike the shots of Patent Documents 3, 4, and 5, the zinc-based alloy shot of the present invention does not contain Ni, Mn, etc., which are the objects to be controlled under the PRTR (Pollutant Release and Transfer Register). So, it is preferable in view of environmental conservation and for a safe operation.

Further, for the zinc-based alloy shot of the present invention, the Cu content can be lowered relatively when a shot of the same hardness is manufactured. For this reason, the lowering of the toughness of the shot can be prevented and the wear and tear (fracture) are controlled. In the shot blasting treatment, after the shots are projected on the work, those shots that are less affected by wear and tear are recycled for use and again projected to the works. As the wear and tear are controlled, the life of the shots becomes longer.

EMBODIMENT FOR CARRYING OUT THE INVENTION

Figure 1:
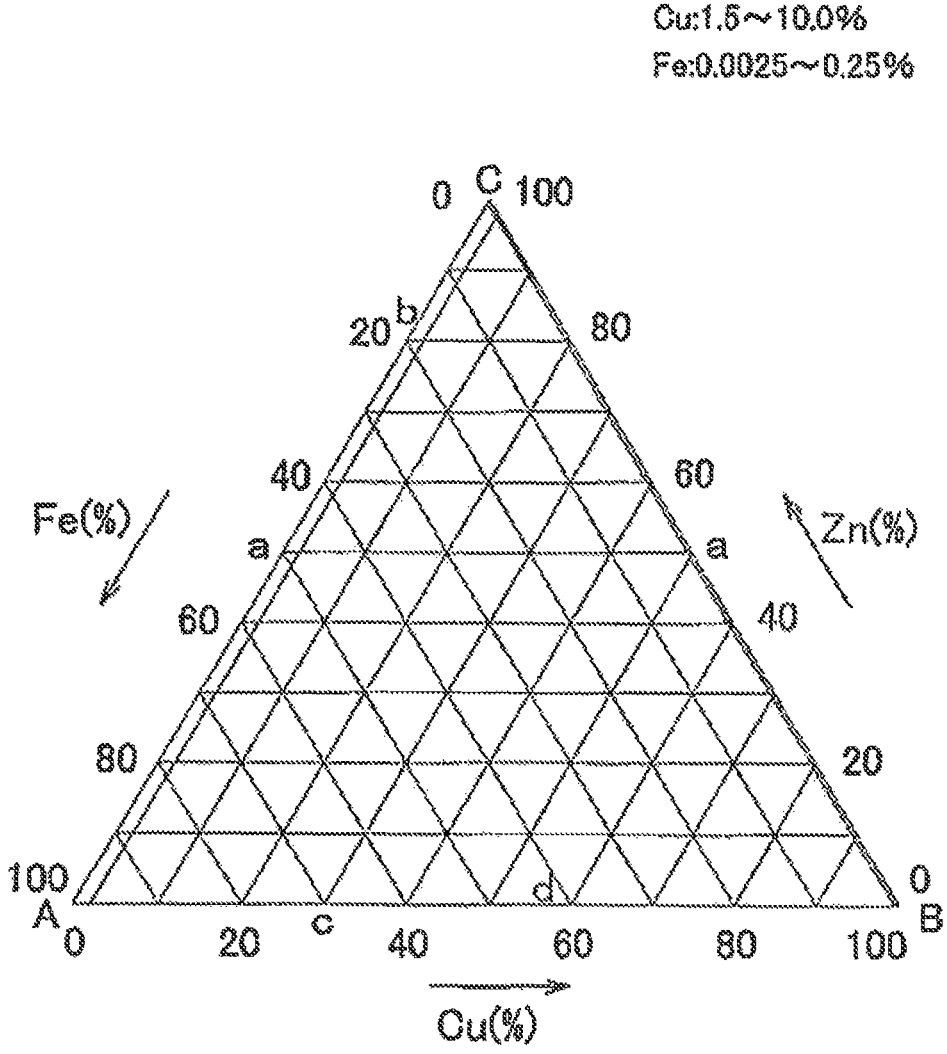
FIG. 1 gives a diagram showing the range of the composition of alloy of the three-component system of the present invention.

Below the zinc-based alloy shot of the present invention is explained in detail. FIG. 1 shows a schematic view of the range of the composition of the three component system of the zinc-based alloy shot (dark stained part) of the present invention. The zinc-based alloy shot of the present invention comprises Cu as the main additive element and also Fe as a co-additive element, for the purpose of increasing the hardness.

The Cu in the zinc-based alloy shot acts to increase the mechanical strength and the hardness (Vickers hardness) of the zinc alloy. If the Cu content is too low, such effects will not be obtained. But if the Cu content is high, the mechanical strength and hardness (Vickers hardness) of the zinc alloy will be improved. But the toughness (impact resistance) will show a sign of a decrease.

The Fe content, if added (comprised) in even a small amount, acts to increase hardness in cooperation with the Cu and also prevents corrosion (reduces color change). If the Fe content is too low, such effects will not be obtained. But if the Fe content is high, then, as seen with the Cu content, similarly the mechanical strength and hardness (Vickers hardness) of the zinc alloy will be improved. But the toughness (impact resistance) will show a sign of a decrease.

The chemical composition of the zinc-based alloy shot can be suitably determined, depending on the balance between the Vickers hardness and the toughness.

For example, to obtain the zinc-based alloy shot having a Vickers hardness of 40-150 HV, the chemical composition should be Cu: 0.1~13.0 mass %; Fe: 0.0025~0.25 mass %; Zn: balance; and $1 \leq$ Cu/Fe(measured in mass)$\leq 1000$.

Also, to obtain the zinc-based alloy shot having a Vickers hardness of 60-150 HV, the chemical composition should be Cu: 1.5~10.0 mass %; Fe: 0.0025~0.25 mass %; Zn: balance; and $20 \leq$ Cu/Fe(measured in mass)$\leq 1000$.

To obtain the zinc-based alloy shot having a Vickers hardness of 70-125 HV, the chemical composition should be Cu: 2.0~5.0 mass %; Fe: 0.03~0.1 mass %; Zn: balance; and $20 \leq$ Cu/Fe (measured in mass)$\leq 100$.

If the Vickers hardness of the zinc-based alloy shot is below 40 HV, the capabilities of removing burrs and of grinding and polishing are insufficient, while if the Vickers hardness of the zinc-based alloy shot is above 150 HV, cracking and wear of the zinc-based alloy shot easily increase when removing burrs and when grinding and polishing the work are carried out. So, the consumption of the shots is likely to increase. This is caused because the zinc-based alloy shot has a low toughness. Also, if the zinc-based alloy shot that has a Vickers hardness above 150 HV is used for the surface treatment (removing burrs, grinding and polishing, shot peening treatment, etc.) of a light alloy metal product made of an aluminum alloy, a zinc alloy or a magnesium alloy, the surface of the light alloy metal product is damaged or it tends to be treated more than necessary. As a result it would have a satin-like surface and the desired surface roughness might not be maintained.

Also, to obtain a zinc-based alloy shot having a Vickers hardness of about 60-150 HV as given in Patent Document 2, as shown above the Cu content of the shot can be 1.5~10.0%, which is lower than the Cu content of 1.8~13.0%. This may be because the hardness of the shot is greatly increased by the addition of Fe content.

As shown above, by having a small amount, as compared with the Cu content (1.5~10.0%), of Fe (0.0025~0.25%) added together with Cu, the Cu content can be greatly reduced, even for obtaining a shot having the same hardness. Thus lowering the toughness of the shot can be prevented (see the section "Vickers hardness" in the paragraph titled "Evaluation test for shot blasting" in the example).

The total quantity of the elements (the unavoidable impurities) other than the three components (Zn, Cu, and Fe) that are included in the zinc-based alloy shot of the present invention should be as little as possible.

If the quantity of the impurities that are unavoidably included is high, the shot is likely to lose toughness (tends to have cracks), which leads to a shorter life. If the raw materials of Zn, Cu, etc., (base metals) include Fe as impurities, the Fe thus included can be utilized as a part of, or the whole of, the co-additive element of the present invention. For example, if the quantity of the Fe that is included in Zn or Cu as impurities is more or less equal to that of the Fe that is required to be added to the zinc-based alloy shot of the present invention, no addition of Fe is necessary. If the quantity of the Fe that is included in Zn or Cu as impurities is less than that of the Fe that is required to be added to the zinc-based alloy shot, the Fe should be added in the amount that is necessary to make up for the deficiency.

As the Zn material (base metals) that is the base element, a normal-grade zinc of JISH2107 (99.97% or more), a high-grade zinc (99.995% or more), a special-grade zinc (99.99% or more), etc., can be used. For example, the Fe content of the normal grade zinc is 0.005% or less.

As the Cu material (base metal), electrolytic copper (99.96% or more), etc., of JISH2121 can be used.

Also, as the Fe material (base metal) various steel ingots, steel billets, and steel materials conforming to JIS G 0203 can suitably be used.

The average particle diameter of the zinc-based alloy shot of the present invention (median diameter) varies depending on the strength of the work and the purpose of the treatment of the work. But it usually should be in a range of 0.1-3.5 mm, and in view of yield and demand, it is preferably 0.3-2.3 mm, or more preferably 0.3-1.2 mm. If the average particle diameter were too small, sufficient capabilities of removing burrs, of grinding and polishing and a peening effect (for example, compressive residual stress), could hardly be obtained. In contrast, if the average particle diameter were too large, the surface of the work would be damaged in the surface treatment (removing burrs, grinding and polishing, shot peening treatment, etc.) or the surface would be treated more than necessary such that it would have a satin-like surface, and so a desired surface roughness might not be maintained.

As stated above, the corrosion of the zinc-based alloy shot of the present invention is suppressed by the addition of Fe (co-additive element) so that the corroded parts of the shot are not transferred to the surface of the works. For this reason, if the shots are applied in treating the surface of a light alloy metal product that is made from an aluminum alloy, a zinc alloy or a magnesium alloy, suppressing the darkening of the work can be expected.

The zinc-based alloy shot of the present invention should preferably be manufactured by for example, the following steps: dropping molten metal in a cooling medium like water, etc.; having the molten metal solidified and deposited in the cooling medium; drying the solidified deposits that are obtained in the step of the molten metal being solidified and deposited; and separating particles that are obtained in the step of drying the solidified deposits. The molten metal that is dropped in the cooling medium is rapidly cooled so that the shots thus manufactured have a fine and uniform composition compared with casting material in general. When zinc-based alloy shots are used in shot blasting or shot peening, they are subjected to very large outside force. So, by having a fine and uniform composition, the zinc-based alloy shot of the present invention has improved mechanical properties such as in impact resistance and tensile strength, so that it can suitably be used as zinc-based alloy shot. Manufacturing the zinc-based alloy shot of the present invention by using the method as above described is explained below (see FIG. 2).

First, ingots (materials) 12 of the base element (Zn) and additive elements (Cu and Fe) are measured and put into a melting pot 14 so that the shot is to have a predetermined ratio of the elements in the metal alloy. Then by the melting pot 14 being heated by a heating device (resistance heating) 15, the ingots that are put into the melting pot 14 are melted, and molten metal 16 is obtained. The temperature for heating and melting the ingots varies depending on the composition of the alloy and the manufacturing scale, but it is normally set at 550-700 degree Celsius. The melting points of the elements are the following:

Zn: 419.6 degree Celsius; Cu: 1,083.4 degree Celsius; and Fe: 1,535 degree Celsius.

Next the molten metal 16 is poured into a container for holding molten metal 18. The container for holding the molten metal 18 has a heating device (resistance heating) 20, thereby holding the molten metal 16 so that it cannot be cooled more than necessary. The temperature for holding molten metal varies depending on the composition of the alloy and the manufacturing scale, but is normally set at 450-650 degree Celsius.

A nozzle for causing molten metal 22 to drip, through which the molten metal falls, is provided at the bottom of the container for holding the molten metal 18. Below the nozzle for causing molten metal 22 to drop, a cooling bath 28, next to which is located a cooling device (cooling tower) 26, is provided. The cooling medium 24 can be oil, etc.

The molten metal 16 in the container for holding molten metal 18 passes through the air when it falls from the nozzle for causing the molten metal 22 to drip into the cooling medium 24. So the molten metal 16 contacts the air and also it is cooled by its contact with the cooling medium 24. So, the molten metal 16 is to have a spherical shape because of the surface tension.

The temperature of the cooling medium 24 becomes higher as the molten metal that falls in drops contacts it. Thus the cooling medium 24 may prevent rapid cooling of the molten metal that falls in drops. So the temperature of the cooling medium 24 is kept constant at a predetermined temperature by means of the cooling device (cooling machine) 26. The predetermined temperature is, for example, usually below 60 degree Celsius, if the cooling medium is water. If the temperature is above 60 degree Celsius, the water that contacts the molten metal that falls in drops (droplets) boils and thus causes the surface to be in a vaporizing condition, whereby maintaining a rapid cooling of the molten metal is difficult.

The particles of the zinc alloy 30 accumulate at the bottom of the cooling medium 24. The particles of the zinc alloy 30 are collected, dried in a dryer (rotary dryer) 32, and then separated by a separator (vibrating screen) 34 to manufacture the zinc-based alloy shot. The separation is carried out so that the zinc-based alloy shots have desired diameters that comply with the purpose of use.

The method of manufacturing the zinc-based alloy shot is not limited to the method of granulation by dripping as given above. For example, a well-known method such as a gas-atomizing method, centrifugal-atomizing method, water-atomizing method, etc., can suitably be selected depending on the shape, particle size, etc., of the shot that suits the purpose of use.

EXAMPLES

Below the results of the tests to evaluate the effects of the invention are explained.

Figure 2:
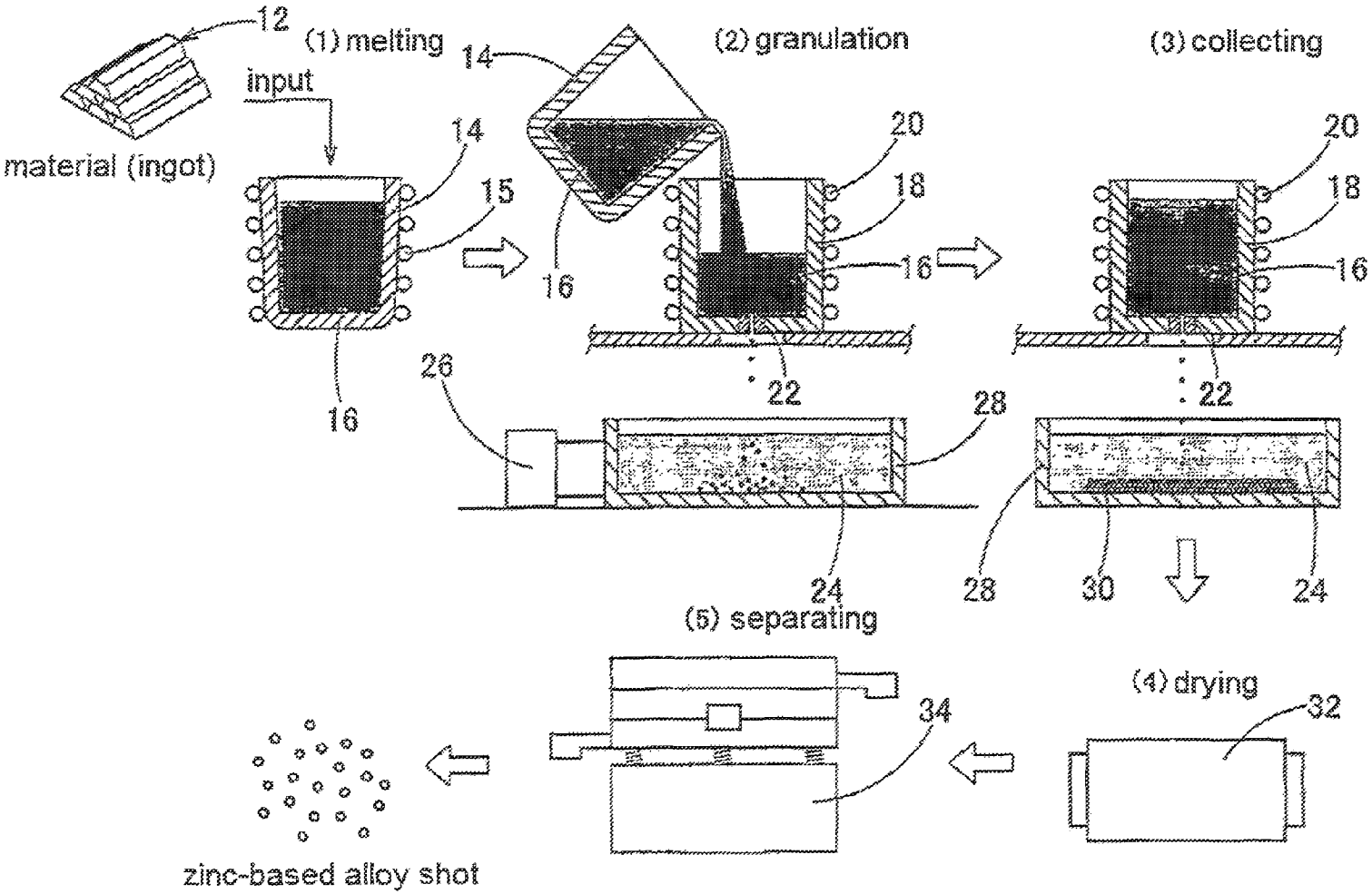
FIG. 2 gives one example of a flow diagram of the manufacturing method of the zinc-based alloy shot of the present invention.

The zinc-based alloy shots that were manufactured using the method of FIG. 2 (method of granulation by dripping) have the composition that is shown in Table 1. The zinc-based alloy shots thus manufactured were separated and the samples of shots for projection having the average particle diameter (median diameter) of 1.0 mm and that were used for the evaluation tests were prepared. The items listed in the Table were measured and the results were evaluated.

TABLE I

| Sample No. | | 1 | 2 | 3 |
|---|---|---|---|---|
| Chemical composition (%) | Fe | 0.005 | 0.05 | 0.2 |
| | Cu | 2.5 | 2.5 | 2.5 |
| | Zn | balance | balance | Balance |
| Vickers hardness (HV) unused | | 91.2 | 100.1 | 101.7 |
| life (cy) | | 3962 | 3764 | 3764 |
| Compared with sample No. 1 (%) | | 100% | 95.0% | 92.0% |

(1) Evaluation Test for Shot Blasting

Each sample for the shots (the average particle diameter 1.0 mm) was prepared in 100 kg batches by the method as stated above, and was projected on a steel stock (a Rockwell hardness of 65 HRC [defined according to JIS G0202, JIS Z2245]) as a target by the "Ervin Test Machine" (manufactured by Ervin Industries) with a projection speed of 60 m/s for 5,000 times (shots).

1) Vickers Hardness

The ten samples (each shot having a diameter of 1 mm) for each group were buried in a bed of resin and fixed. Then the shots were cut in half and the test samples were prepared.

The Vickers hardness of each test sample was measured according to JIS Z 2244 before it was used (before it was projected). Table 1 shows an arithmetic average of the results of the measurements (n=10). Table 1 shows that by having a small amount of Fe added, a shot having a high hardness can be easily obtained even if the Cu content is as little as 2.5%. This is supported by comparing test Sample No. 2 of the present invention and shot No. 3 of Patent Document 3 (Paragraph 0015, Table 1), where the Cu contents of the samples are close to each other. The shot of the present invention (Sample No. 2) has Cu: 2.5%; Fe: 0.05%; total Cu/Fe: 2.55%; and has a Vickers hardness of 100.1 HV, while the shot of Patent Document 2 (Shot No. 3)

has Cu: 3.12%; Fe: 0.02%; total Cu/Fe: 3.14%; and has a Vickers hardness of 95.6 HV. As is seen from Table 1, if the Fe content becomes greater, so does the Vickers hardness.

Figure 3:
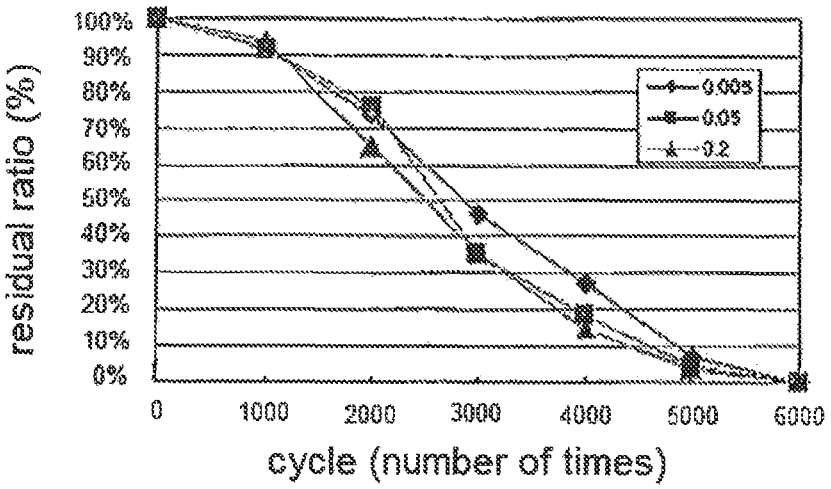
FIG. 3 is a graph showing the results of a test of the life (residual ratio on a screen against the number of projections) of the zinc-based alloy shot of the present invention.
Figure 4:
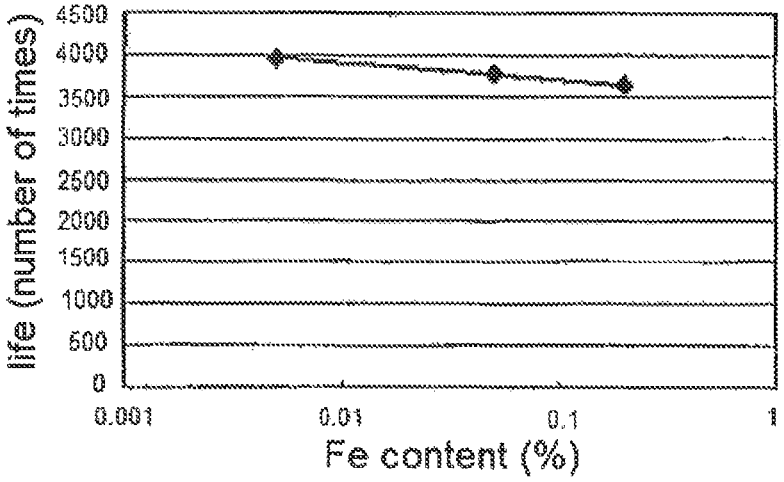
FIG. 4 is a graph showing the relationship of the Fe content to the life of the shots, based on FIG. 3.

2) Life of the Shot:

For all sample shots, the shots that are projected are separated by a screen (aperture: 0.85 mm) at every projection of the shots and the quantity of the shots that remain on the screen is measured (residual ratio). The results are shown in FIG. 3. The number of projections for a shot where the retention rate becomes about 30% is supposed to mean that the shot comes to the end of its life. The results are shown in FIG. 4. From these results it is seen that if the Fe content increases, the life of a shot likely becomes shorter. But the life of Sample No. 3, which has a Fe content of 0.2% can be about 90% or more when compared with the life of a shot where the Fe content of Sample No. 1 is 0.005%, and which life is taken as 100%. Further, the life of Sample No. 2, which has a Fe content of 0.05%, can be about 95% or more. So, the shots having these Fe contents do not cause any problem in use.

(2) Corrosion Test

Cylinder-shaped samples (a 2 mm diameter×10 mm) that are obtained from the material having the same composition as the samples used in the tests were buried, with 10 samples in one group, horizontally in a bed of resin, and fixed. Then the cylinder-shaped samples were cut in half in the direction of the axis and the test samples were prepared. Neutral salt spray test was carried out for each sample according to the rules equivalent to JIS Z2371. The corrosion of the exposed surface of the alloy (white rust: ZnO) was measured with a precision scale (calipers) and visually. The results were calculated according to the formula given below. The color of the corroded surface was white.

Figure 5:
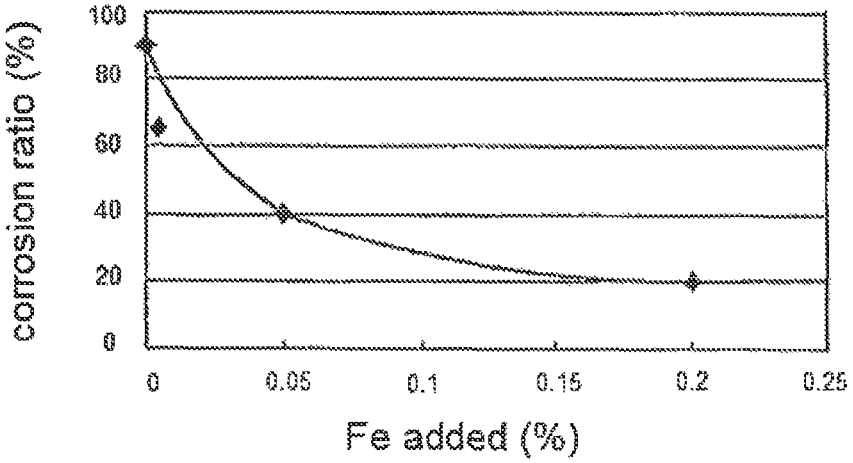
FIG. 5 is a graph showing the results of corrosion tests.

Corrosion ratio (%)=100×corroded area ($mm^2$)/total surface area of sample ($mm^2$). As is observed from FIG. 5, if a small amount of Fe (0.0025-0.25%) is added the corrosion ratio is substantially decreased.

As seen from the foregoing analyses in the "Evaluation test for shot blasting" and the "Corrosion test," the zinc-based alloy shot of the present invention, which has the main additive element Cu and co-additive element Fe, easily attains a desired Vickers hardness, has a life (toughness) that is sufficient for practical use, and has superior corrosion resistance.

The basic Japanese patent application, No. 2010-280807, filed Dec. 16, 2010, is hereby incorporated in its entirety by reference in the present application. The present invention will become more fully understood from the detailed description of this specification. However, the detailed description and the specific embodiment illustrate desirable embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

Symbols

12 ingot (base metal)
14 melting pot
16 molten metal
18 container for holding molten metal
22 nozzle for causing molten metal to drip
24 cooling medium
32 dryer
34 separator

The invention claimed is:

1. A zinc-based alloy shot of a composition of a three-component system of Cu as the main additive element for increasing the Vickers hardness, and Fe as a co-additive element for increasing the Vickers hardness and for preventing corrosion, having a chemical composition of Cu: 0.1~13.0 mass %; Fe: 0.0025~0.005 mass %; Zn: balance: and 20≤Cu/Fe(measured in mass)≤1000, and having a Vickers hardness of 50-150HV.

2. A zinc-based ahoy shot of a composition of a three-component system of Cu as the main additive element for increasing the Vickers hardness, and Fe as a co-additive element for increasing the Vickers hardness and for preventing corrosion, having a chemical composition of Cu:1.5~10.0 mass %; Fe: 0.0025~0.005 mass %; Zn: balance; and 300≤Cu/Fe (measured in mass)≤1000 and having a Vickers hardness of 60-150 HV.

3. The zinc-based ahoy shot of claim 1 or claim 2, wherein the Zn material that is the base element has purity of 99.9% or more.

4. The zinc-based alloy shot of claim 1 or claim 2, wherein the average particle diameter of the zinc-based alloy shot is in a range of 0.1-3.5 mm.

5. The zinc-based alloy shot of claim 1 or claim 2, wherein the average particle diameter of the zinc-based alloy shot is in a range of 0.3-2.3 mm.

6. The zinc-based shot of claim 1 or claim 2, wherein the average particle diameter of the zinc-based alloy shot is in a range of 0.3-1.2 mm.

7. The zinc-based alloy shot of claim 1 or claim 2, wherein the zinc-based alloy shots are applied in treating the surface of light alloy metal product that is made from an aluminum alloy, a zinc alloy or a magnesium alloy.

8. The zinc-based alloy shot of claim 1 or claim 2, wherein the zinc-based alloy shot is manufactured by the following steps: dropping molten metal in a cooling medium; having the molten metal solidified and deposited in the cooling medium; drying the solidified deposits that are obtained in the step of the molten metal being solidified and deposited; and separating particles that are obtained in the step of drying the solidified deposits.

* * * * *